US005655874A

United States Patent [19]

Subramanian

[11] Patent Number: 5,655,874

[45] Date of Patent: Aug. 12, 1997

[54] ELLIPTICAL VORTEX WALL FOR TRANSVERSE FANS

[75] Inventor: Srinivasan Subramanian, Liverpool, N.Y.

[73] Assignee: Carrier Corporation, Syracuse, N.Y.

[21] Appl. No.: 659,481

[22] Filed: Jun. 6, 1996

[51] Int. Cl.[6] ..... F04D 5/00

[52] U.S. Cl. ..... 415/53.1; 415/119

[58] Field of Search ..... 415/53.1, 53.2, 415/53.3, 119

[56] References Cited

U.S. PATENT DOCUMENTS 3,232,522 2/1966 Laing ..... 415/53.3

3,695,775 10/1972 Zenkner ..... 415/53.1

5,248,224 9/1993 Amr .

5,449,271 9/1995 Bushnell et al. ..... 415/53.1

*Primary Examiner*—Christopher Verdier

[57] ABSTRACT

Changing the tip of the vortex wall to an ellipse can increase flow performance by having the short side of the ellipse define a portion of the converging diverging section while quieter operation can be achieved by having the long side of the ellipse define a portion of the converging diverging section with no other changes. A combination of increased flow and reduced noise can be achieved by combining changing the clearance between the vortex wall and the impeller with an elliptical surface as well as by reorienting the elliptical surface.

2 Claims, 2 Drawing Sheets

ELLIPTICAL VORTEX WALL FOR TRANSVERSE FANS

BACKGROUND OF THE INVENTION

Transverse fans are also known as cross-flow and tangential fans. They are used in air conditioning applications because of their in-line flow capabilities and their suitable relationship with plate-fin heat exchangers since they can extend the entire length of a heat exchanger. In a transverse fan, the inlet and outlet are, generally, nominally, at right angles but angles from 0°to 180° are possible. The impeller is similar to a forward curved centrifugal fan wheel except that it is closed at both ends. The flow is perpendicular to the impeller axis throughout the fan (two dimensional flow), and enters the blade row in the radially inward direction on the upstream side, passing through the interior of the impeller, and then flowing radially outward through the blading a second time. The flow is characterized by the formation of an eccentric vortex that runs parallel to the rotor axis and which rotates in the same direction as the rotor.

A two stage action occurs as the flow passes first through the suction (upstream) blading and then through the discharge blades. The flow contracts as it moves across the impeller producing high velocities at the discharge blades (second stage). The flow leaves the impeller and contracts again as it turns and squeezes around the vortex. The combination of these effects results in the high pressure coefficients attained by transverse fans. A vortex wall separates the inlet from the outlet and acts to stabilize the vortex. Since there is only re-circulating flow in the region of the vortex, no useful work is done there. The main effect in the vortex is energy dissipation. Fan stability is, however, highly sensitive to vortex wall clearance. This parameter must be controlled very carefully since a trade-off has to be made between stable, high performance and tone noise generated by interaction of the impeller with the vortex wall.

SUMMARY OF THE INVENTION

A vortex wall is provided with an elliptical surface facing the impeller rather than a circular surface, as is conventional. For a given clearance between the vortex wall and the impeller, an elliptical surface will provide an improved flow performance or a sound reduction as compared to a similarly placed circular surface. Basically, the smaller the clearance or gap, the more stable and noisier the fan. The flow increase or sound reduction depends upon the orientation of the elliptical surface. If the major axis of the elliptical surface is on a line corresponding to the direction of the vortex wall, the curved surface is narrower and flow performance increases whereas if the major axis of the elliptical surface is on a line perpendicular to the direction of the vortex wall, the curved surface is wider and there is a reduction in sound due to the coaction with the passing blades. Alternatively, the sound or flow standard of a circular curved surface can be maintained while improving the other factor by changing the clearance between the impeller and elliptical vortex wall.

It is an object of this invention to improve performance in transverse fans.

It is another object of this invention to improve noise ratings for a transverse fan. These objects, and others as will become apparent hereinafter, are accomplished by the present invention.

Basically, the impeller and the tip of the vortex wall coact to define a converging-diverging clearance with the wall defining an elliptically curved surface and the impeller defining a circularly curved surface.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
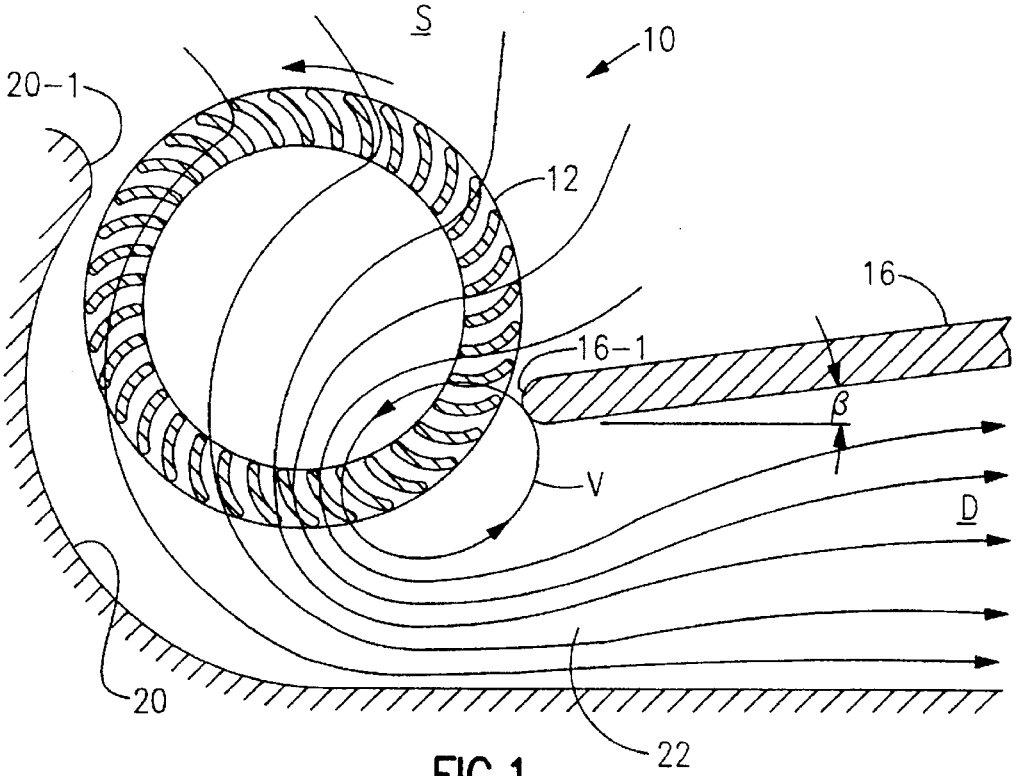
FIG.1 Prior Art
FIG. 1 is a sectional view of a PRIOR ART transverse fan showing the fluid paths therethrough.

In FIG. 1 the numeral 10 generally designates a PRIOR ART transverse fan. Fan 10 includes an impeller or rotor 12, a vortex wall 16 and a rear wall 20. Curved inlet portion 20-1 of rear wall 20 and curved tip 16-1 of vortex wall 16 coact with impeller 12 to define and separate the suction side, S, from the discharge side, D, of fan 10. Vortex wall 16 and the discharge portion of rear wall 20 form an angle β. The circularly curved tip 16-1 and the cylindrical impeller 12 coact to define a converging-diverging flow path between the suction and discharge sides. Because both tip 16-1 and impeller 12 are circular, they present facing cylindrical surfaces in three dimensions and they are symmetrical in both directions with respect to the throat of the converging-diverging section to the extent of the minimum circular extent of tip 16-1.

With counterclockwise rotation of impeller 12, as illustrated, the flow path of the air is shown by the arrows. It will be noted that one arrow, V, defines a closed fluid path or vortex delimited in part by vortex wall 16. The presence of vortex V causes air discharging from impeller 12 to be squeezed between the vortex V and the rear wall 20, as is clearly shown in FIG. 1, maintaining a high velocity. Downstream of vortex V, the flow expands very rapidly in the diffuser section 22 as it moves to the fan exit. This expansion process is augmented by vortex V since, without the vortex, the flow would separate from the walls in the diffuser section 22.

Figure 2:
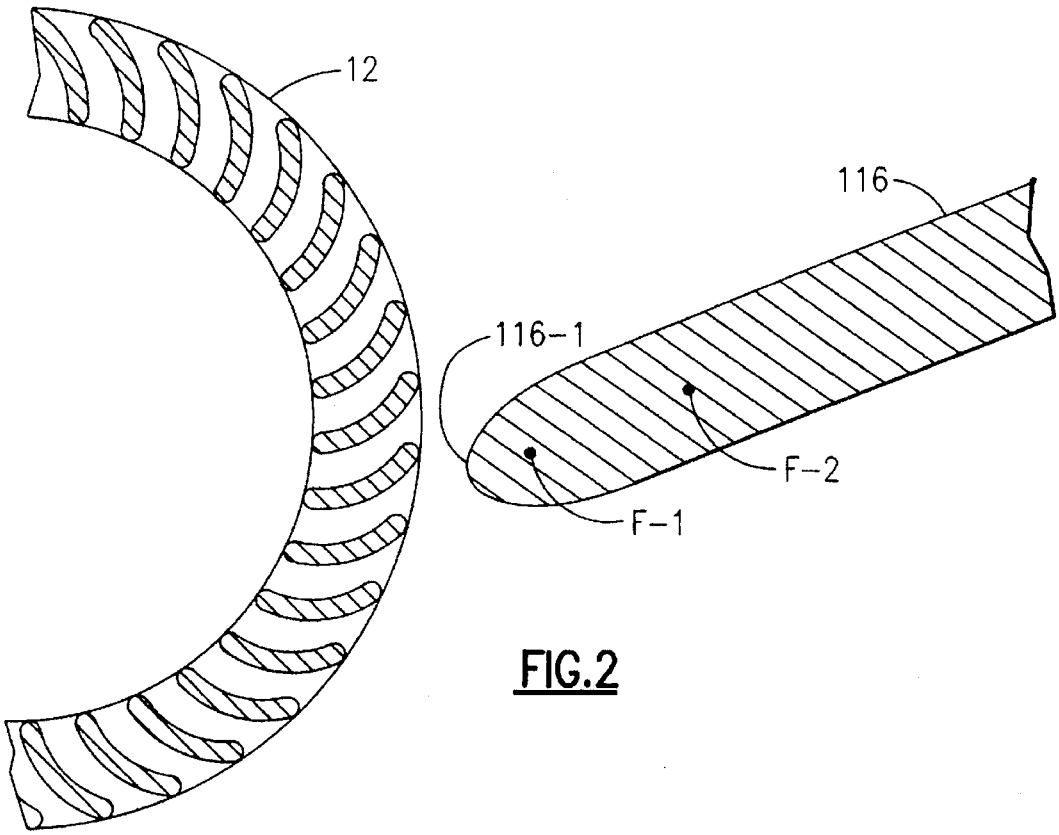
FIG. 2 is a sectional view of the vortex wall of the present invention.
Figure 3:
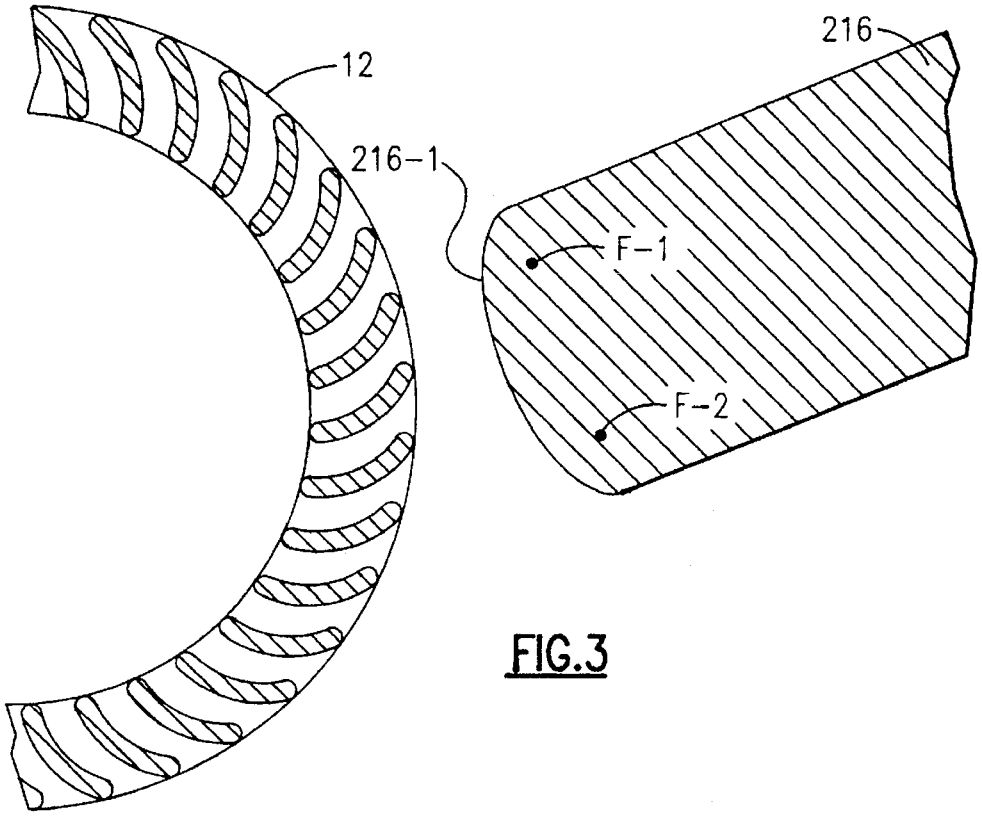
FIG. 3 is a sectional view of a modified vortex wall.
Figure 4:
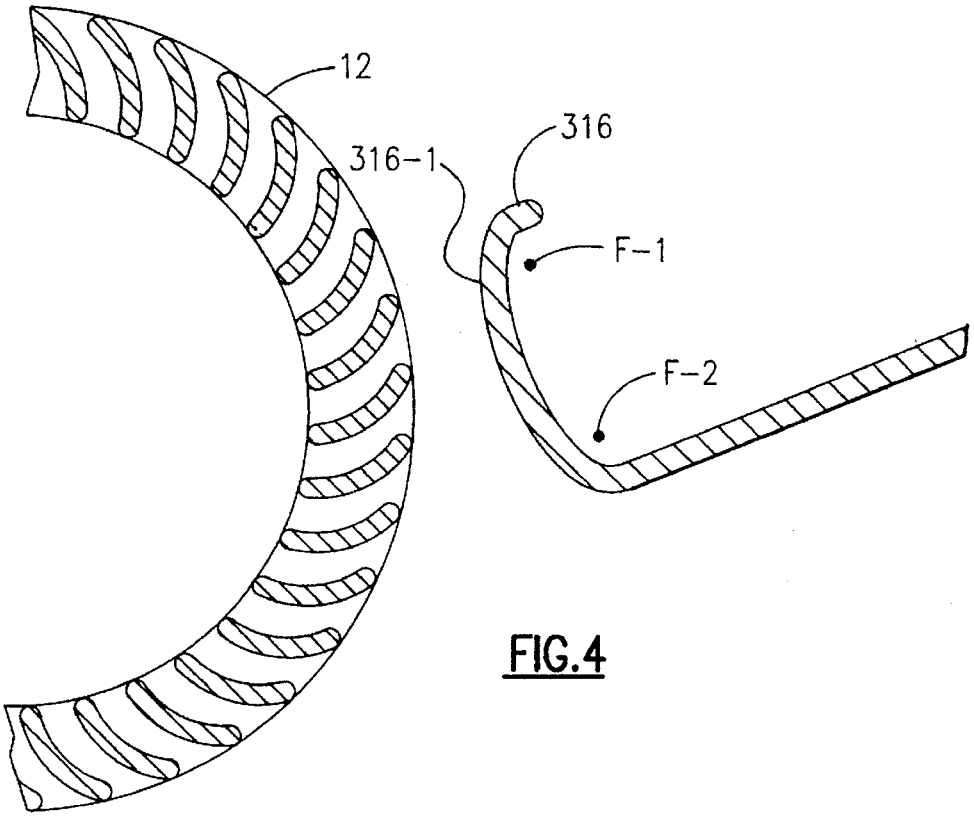
FIG. 4 is a sectional view of a second modified vortex wall.

The present invention modifies tip 16-1 of FIG. 1, which is essentially a half cylinder in three dimensions, to portions of an elliptical surface. In FIG. 2, tip 116-1 of vortex wall 116 is a half elliptical surface of an ellipse having a major axis defined by foci F-1 and F-2 on the centerline of wall 116 as it appears in FIG. 2. In FIG. 3, tip 216-1 of vortex wall 216 is a half elliptical surface of an ellipse having a major axis defined by foci F-1 and F-2 on a line perpendicular to the centerline of wall 216 as it appears in FIG. 3. FIG. 4 is like FIG. 3 with respect to the surface of tip 316-1 of wall 316 which is presented to the flow. However, wall 316 is made of sheet metal bent into a J-shaped tip 316-1 having an elliptical surface rather than having a more massive wall 216 as in the FIG. 3 embodiment. A mid-point on the major axis between foci F-1 and F-2 is the center of the ellipse from which the major and minor radii of the ellipse are determined. Accordingly, the basic physical difference between tip 116-1 and tips 216-1 and 316-1 is that the ellipse is rotated 90° between the FIG. 2 embodiment and the FIGS. 3 and 4 embodiments and presents different elliptical surfaces. Except in the special case where the axis of wall 116, 216 or 316 is on a diameter of impeller 12, surfaces 116-1,216-1 and 316-1 coact with impeller 12 to define a converging-diverging throat which is non-symmetrical with respect to the throat. Given that this is the location for vortex V, and that the blades of impeller 12 have their smallest clearances with tips 116-1, 216-1 and 316-1 respectively, the coactions are quite different than those of the PRIOR ART fan 10 of FIG. 1.

In FIG. 2, the shorter side of the ellipse produces a shorter converging-diverging section. As a result of the configuration of tip 116-1 there would be increased flow compared to the case of tip 16-1 with all other factors being the same.

In FIG. 3, the longer side of the ellipse produces a longer converging-diverging section. As a result of the configuration of tip 216-1 there would be a quieter operation and less tonal content than in the case of tip 16-1 with all other factors being the same. The FIG. 4 embodiment operates in a similar fashion.

The FIG. 2 configuration can be modified to increase the throat or gap of the converging diverging portion to reduce flow to provide a quieter operation with both flow and quiet operation being better than in the case of tip 16-1. Similarly, the FIG. 3 and 4 configurations can be modified by reducing the throat of the converging diverging portion to increase flow while increasing noise but with the flow and sound being better than in the case of tip 16-1.

In redesigning the PRIOR ART circular vane tip 16-1 of FIG. 1, the range of radius of the minor axis of the ellipse redefining tip 16-1, $R_{minor}$, must be in the range of:

$$0.02 \leqq \frac{R_{minor}}{D_o} \leqq 0.15$$

where $D_o$ is the diameter of impeller 12. For a given value for $R_{minor}$, the range of: $R_{minor}$, the major radius of elliptical tip 116-1 or 216-1 must be in the range of:

$$1.1 \leqq \frac{R_{major}}{R_{minor}} \leqq 6.0$$

For the FIG. 2 and 3 embodiments, the minimum space or clearance between the vortex wall and the impeller, $d_{gap}$, is in the range of:

$$0.02 \leqq \frac{d_{gap}}{D_o} \leqq 0.15$$

and the range of vortex wall angles, 13 is in the range of:

$$0° \leqq \beta \leqq 50°$$

From the foregoing explanation, it should be clear that the PRIOR ART circular tip 16-1 can be modified into tip 116-1 or 216-1 using the teachings of the present invention and that further modification can be made by changing $d_{gap}$, as shown above. Also, FIGS. 2 and 3 represent extreme limits of the orientation of the elliptical surface and intermediate positions are possible.

Although preferred embodiments of the present invention have been illustrated and described, other modifications will occur to those skilled in the art. It is therefore intended that the present invention is to be limited only by the scope of the appended claims.

What is claimed is:

1. A transverse fan means including an impeller having a rotor having an outer diameter, $D_o$, a vortex wall having a tip spaced from said rotor by a clearance, $d_{gap}$, and a rear wall which coacts with said vortex wall to define a discharge portion having an angle, β, said tip having an elliptical surface having foci and spaced from said rotor with:

$$0.02 \leqq d_{gap}/D_o \leqq 0.15,$$

and $$0° \leqq \beta \leqq 50°,$$

and wherein said elliptical surface has a major radius, $R_{minor}$, and a minor radius, $R_{major}$, such that:

$$1.1 \leqq \frac{R_{major}}{R_{minor}} \leqq 6.0$$

where $$0.02 \leqq \frac{R_{minor}}{D_0} \leqq 0.15.$$

2. A transverse fan means including an impeller having a rotor having an outer diameter $D_o$, a vortex wall having a tip spaced from said rotor by a clearance, and a rear wall which coacts with said vortex wall to define a discharge portion having an angle, said tip having an elliptical surface having foci and spaced from said rotor and wherein said elliptical surface has a major radius, $R_{major}$, and a minor radius, $R_{minor}$, such that:

$$1.1 \leqq \frac{R_{major}}{R_{minor}} \leqq 6.0$$

where $$0.02 \leqq \frac{R_{minor}}{D_0} \leqq 0.15.$$

* * * * *